US005727479A

United States Patent [19]

McAfee et al.

[11] Patent Number: 5,727,479

[45] Date of Patent: Mar. 17, 1998

[54] FURNACE DOOR CLOSURE SYSTEM

[75] Inventors: Joe R. McAfee, Pepper Pike; Doug A. Kreuder, Medina, both of Ohio

[73] Assignee: ETS Schaefer Corporation, Streetsboro, Ohio

[21] Appl. No.: 721,280

[22] Filed: Sep. 26, 1996

[51] Int. Cl.[6] ..... F23M 7/00

[52] U.S. Cl. ..... 110/176; 110/173 R; 110/175 A; 110/177

[58] Field of Search ..... 110/173 R, 176, 110/177, 173 A

[56] References Cited

U.S. PATENT DOCUMENTS

| | | | |
|---|---|---|---|
| 2,804,855 | 9/1957 | Bergman | 110/173 R |
| 2,953,108 | 9/1960 | Kelsen | 110/173 R |

*Primary Examiner*—Henry A. Bennett
*Assistant Examiner*—Pamela A. O'Connor
*Attorney, Agent, or Firm*—Thompson Hine & Flory LLP

[57] ABSTRACT

A guillotine-style door closure system for a furnace comprises a furnace opening with a door frame on a vertical side of the furnace; a furnace door adapted to mate with the frame; a left closing chain mounted, at one end, to the vertical side of the furnace approximate the left jamb and the lintel of the frame, and mounted, at its other end, to a left pin extending from the furnace door approximate the left vertical side of the door, below the vertical centerline of the door and distal from the rear vertical side of the door; and a right closing chain mounted, at one end, to the vertical side of the furnace approximate the right jamb and lintel of the frame, and mounted, at its other end, to a right pin extending from the furnace door approximate the right vertical side, below the vertical centerline and distal from the rear vertical side of the door. The left and right pins extend from furnace door at a predetermined vertical height which depends upon a sum of all vertical mechanical forces being substantially equal to zero when the door is closed, a sum of all horizontal mechanical forces being substantially equal to zero when the door is closed, and a sum of all moments about a predetermined point being substantially equal to zero when the door is closed.

25 Claims, 3 Drawing Sheets

FURNACE DOOR CLOSURE SYSTEM

BACKGROUND

The present invention relates to a door closure system for an industrial furnace, and more particularly, to a industrial door closure system which provides consistently uniform sealing pressure around the full perimeter of the door.

Conventional guillotine-style doors utilize angular forces converted from the gravitational force of the door and transfer it into a horizontal sealing force by a pair of closing chains. Typically a guillotine-style door closure system will include a furnace door adapted to mate with a furnace door frame, a first closing chain mounted at one end to the furnace to the left door frame jamb, approximate to the door frame lintel and mounted at the other end of the chain to the furnace door approximately at the vertical center of gravity of the door, on the left side of the door; a second closing chain mounted at one end to the furnace approximate to the right door frame jamb, approximate the lintel and mounted at the other end of the chain to the furnace door at the vertical center of gravity of the door on the right side of the door. The guillotine-style door closure system will also include lifting chains mounted to the top of the door for lifting the door upwardly and away from the frame. These lifting chains are typically operated by a motorized pulley system.

The first and second closing chains are of sufficient length such that when the door is lowered, the closing chains will become taut due to the limited length of these chains, thus prohibiting the door from lowering any further and transferring the downward forces horizontally inwardly towards the door frame. These horizontal forces cause the door to mate with the door frame and to be sealed to the door frame. Essentially, when the closing chains are tightened by the gravitational forces of the door, the chains pivot about their attachment points to the furnace creating a pivotal door hinge mechanism.

Current industry practice attaches the closing chains to the door approximately at the symmetrical vertical centerline of the door. Thus, when the door is mated with the door frame, the sealing forces of the door against the door frame result in greater forces on the upper sealing surfaces and lesser forces on the lower sealing surfaces. This is because the forces in the closing chains project along the axes of the chains. Therefore, in the typical case, when the attachment points are on the vertical centerline of the door, the forces of the closing chains will project through the sealing plane (the hot face) of the door, above the center of area. Hence, the pressure on the door surfaces above the projection point will be higher, and those below the projection point will be correspondingly lower.

In the steel industry, hard refractory doors are utilized and variations in sealing pressures along the door frame are of little consequence, provided they are above a given minimal level. With the advent of ceramic fiber-lined doors, the level of sealing pressure of the door around the door frame is critical. It has been found that for sealing pressures below approximately 0.3 psi, the seal for typically low furnace pressures becomes less effective, allowing gases to escape. These gases carry heat to places where it is not intended and can cause damage to adjacent structures. The escape of gases and heat can also induce erosion in the fiber itself. On the other hand, it has also been found that if the sealing pressure exceeds approximately 0.6 psi, the ceramic fiber will begin to crush excessively, thus leading to premature failure of the fiber lining and sealing system.

Accordingly, there exists a need for a guillotine-style door which provides uniform sealing forces along the entire door frame, and which substantially prohibits the escape of gases from between the seal and also substantially inhibits the excessive crushing of the ceramic fibers used for lining the doors.

SUMMARY

The present invention is a guillotine-style door closure system comprising a furnace door adapted to mate with a furnace door frame. A first closing chain is mounted at one end to the left jamb of the door frame, approximate to the lintel, and mounted at its other end to the left side of the furnace door, below the vertical centerline of the door, and distal from the rear vertical side of the door (facing the furnace). A second closing chain is mounted at one end to the right jamb, approximate to the lintel, and mounted at its other end to the right side of the furnace door, below the vertical centerline of the door, and distal from the vertical rear side of the door.

The first and second closing chains are sufficient length such that when the door is allowed to drop freely the chains become taut and thus convert the vertical downward gravitational force of the door into horizontal forces to force the door against the frame such that the door mates and seals with the frame.

When the door is mated with the frame, the closing chains are at an angle such that the chains support the weight of the door while simultaneously drawing the door to mate with the frame. By analyzing the sum of the vertical forces in the closed system, the sum of the horizontal forces in the closed system and the sum of the moments about any point on the closed system; the exact vertical height to attach the closure chains to the door can be calculated such that the sealing pressures around the perimeter of the frame are virtually identical and such that the sealing pressures around the perimeter of the frame can be set to a uniform pressure, preferably between approximately 0.3 psi and approximately 0.6 psi.

Based upon this analysis, the following equation can be derived to calculate the vertical height from the bottom of the door ($D_{CH-H}$) to attach the closure chains to the door:

$$D_{CH-H} = \frac{F_W * D_W + F_L * D_L + F_J * D_J + F_S * D_S - F_{CH-V} * D_{CH-V}}{F_{CH-H}}$$

Where $F_W$ is the weight of the door; $F_L$ is the uniform desired pressure multiplied by the surface area of the portion of the lintel which abuts the door; $F_J$ is the uniform desired pressure multiplied by the combined surface area of the portions of the two jambs which abut the door; $F_S$ is the uniform desired pressure multiplied by the surface area of the portion of the sill which abuts the door; $F_{CH-V}$ is the vertical component of the force of the closure chains; and $F_{CH-H}$ is the horizontal component of the force of the closure chains. The weight of the door, the angle $\phi$, and the geometric dimensions and areas are physically measured quantities, and the pressure P is the uniform pressure that is the desired sealing pressure which is preferably set to be within the range of approximately 0.3 psi to approximately 0.6 psi.

Accordingly, it is an object of the invention to provide a guillotine-style door closure system in which the sealing pressures of the door around the perimeter of the door frame are substantially uniform and such that these pressures can be maintained between approximately 0.3 psi and approximately 0.6 psi. Other objects and advantages of the present invention will be apparent from the following description, the accompanying drawings and the appended claims.

DETAILED DESCRIPTION

Figure 1:
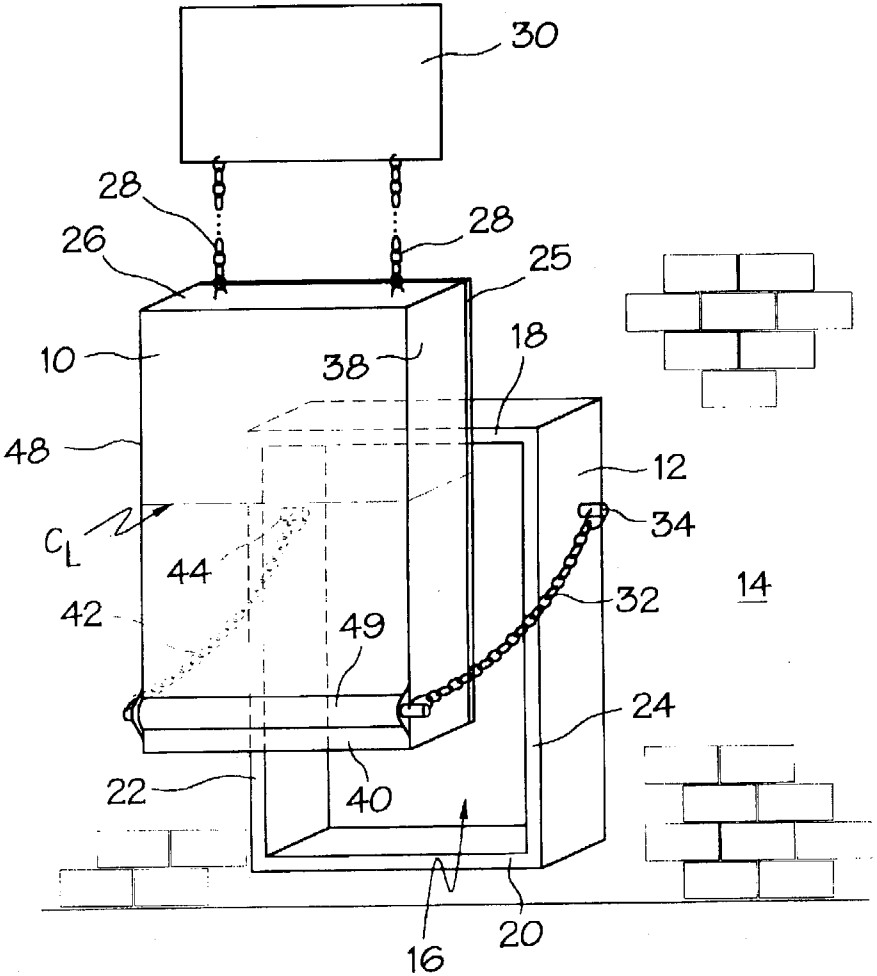
FIG. 1 is a perspective view of the guillotine-style door closure system of the present invention in an open position.
Figure 2:
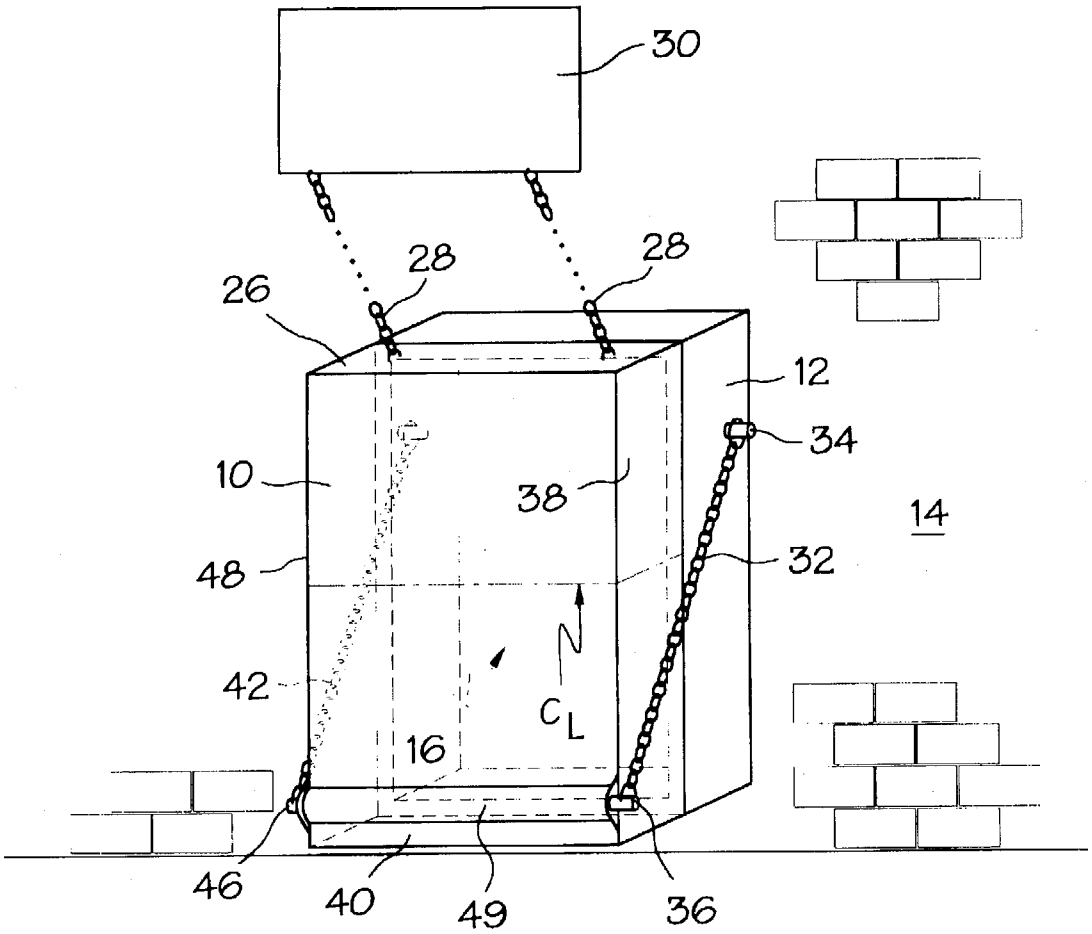
FIG. 2 is a perspective view of the guillotine-style door closure system of the present invention in a closed position.

As shown in FIGS. 1 and 2, a guillotine-style furnace door 10, is adapted to mate with and close against a door frame 12 located on a vertical wall 14 of an industrial furnace. The door frame 12 encloses an opening 16 into the furnace, and includes a lintel 18, a sill 20, a left jamb 22 and a right jamb 24. The frame is permanently mounted to the vertical facing of the furnace and can actually be an extension of the furnace. As shown in FIG. 1, the door 10 includes a ceramic fiber lining or gasket 25 for providing a seal between the door 10 and the frame 12 when closed.

It will be apparent to one of ordinary skill in the art that the door frame 12, although shown to extend from the wall 14, can also be flush with the wall; i.e., just an opening in the furnace wall, where the door mates with the structure around the opening. Furthermore, the present invention is also for use with door closure systems in which there is no sill contact; i.e., the door will mate with the lintel and jamb of the frame, but barely touch the sill/hearth below the door.

The door 10 is typically of a non-uniform density and design, and therefore typically does not have a center of gravity which is centralized with respect to the width and length dimensions of the door.

Mounted to the top 26 of the door are two lifting lines or chains 28 which are lifted and lowered by a motorized pulley system as is generally known in the art, indicated by the numeral 30.

A right support line, or closure chain 32, is pivotally mounted at one end of the chain to a pin 34 extending from the right jamb 24 of the door frame. The other end of the right closure chain 32 is pivotally mounted to a pin 36 extending from the right vertical side 38 of the door, adjacent to the rear face 40 of the door, and below the vertical centerline $C_L$ of the door. The right closure chain 32 can also include turnbuckles, shackles and/or swivels as should be apparent to one of ordinary skill in the art. The vertical centerline $C_L$ represents the horizontal plane through the center of gravity dividing the top half of the mass of the door from the lower half of the mass of the door.

Identically, a left support line, or closure chain 42, is mounted at one end from a pin 44 extending from the left jamb 22 of the door frame and pivotally mounted at the other end of the chain 42 to a pin 46 extending from the left vertical side 48 of the door, adjacent the rear face 40 of the door. The left closure chain 42 can also include turnbuckles, shackles and/or swivels as should be apparent to one of ordinary skill in the art. The pins 36, 46 on the door extend from a closure bar 49 mounted along the rear face 40 of the door, and below the vertical centerline $C_L$ of the door.

As shown in FIG. 1, when the motorized pulley system 30 operates to lift the lifting chains 28, and in turn of the door 10, the horizontal position of the motorized pulley system 30 away from the vertical face 14 of the furnace causes the door to be lifted outward and upward and away from the door frame 12, thus providing access to the opening 16 to the furnace.

As shown in FIG. 2, when the lifting force on the lifting chains 28 is removed, and the door 10 allowed to fall downwardly (the fall, of course, being offset by reverse acceleration on the motorized pulley system 30), the limited length of the closure chains 32 and 42 prohibits the door 10 to be dropped below the door frame 12; and the pivotal attachment of the closure chains 32, 42 to the door 10 and the door frame 12 in combination with the positions of the attachment points of the closure chains 32, 42 causes the downward gravitational force of the door to be transferred into a horizontal force which forces the door against the door frame.

Figure 4:
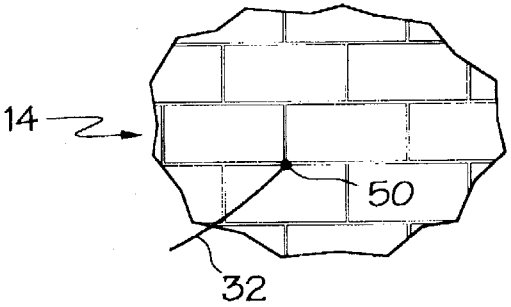
FIG. 4 is a perspective view of a lifting line pivotally attached to the furnace.

It will be apparent to one of ordinary skill in the art that the left and right support lines, while depicted as closure chains 32 and 42 respectively in the present embodiment, can include one or more of any type of support device pivotally mounted at one end to the door 10, and pivotally mounted at the other end to the door frame 12 or to the furnace. What is imperative is that the length and the position of the attachment points of the support lines be adequate to convert the downward gravitational force of the door into a horizontal force for mating the door 10 with the frame 12. Accordingly, it is within the scope of the invention that the support line or lines can include rigid pivot rods or bars, pivotally mounted at one end to the door and pivotally mounted at the other end to the frame or to the furnace; and it is also within the scope of the invention that the support lines can include any suitable flexible support rope, strap, or chain (or a combination thereof) capable of being pivotally attached to the door and to the frame or furnace, and capable of supporting the weight of the door. For the purposes of illustration, FIG. 4 shows a support line, such as closure chain 32, pivotally mounted to the vertical face 14 of the furnace at pivot-point 50.

The magnitude and distribution of the sealing forces that are exerted on the door 10 about the door frame will vary according to the vertical location of the attachment pins 36 and 46. For a given location of attachment points 34 and 44, and for each individual guillotine door closure system of differing specifications (such as door geometry, weight, and angle of the closure chains), there will be one optimal location below the horizontal centerline the rear door face 40 for the placement of the pins 36, 46, such that the sealing forces will be distributed in a substantially uniform manner about the perimeter of the door frame. As will be described in further detail below, since the closure chains 32, 42 transmit force axially, it does not matter where they are physically attached to the door 10, provided that their projected forces project through the plane of the rear vertical side (facing the furnace opening 16) of the door at the proper spot. Essentially, the closure chains 32, 42 can be attached to the door 10 anywhere along that projected line of force.

Figure 3:
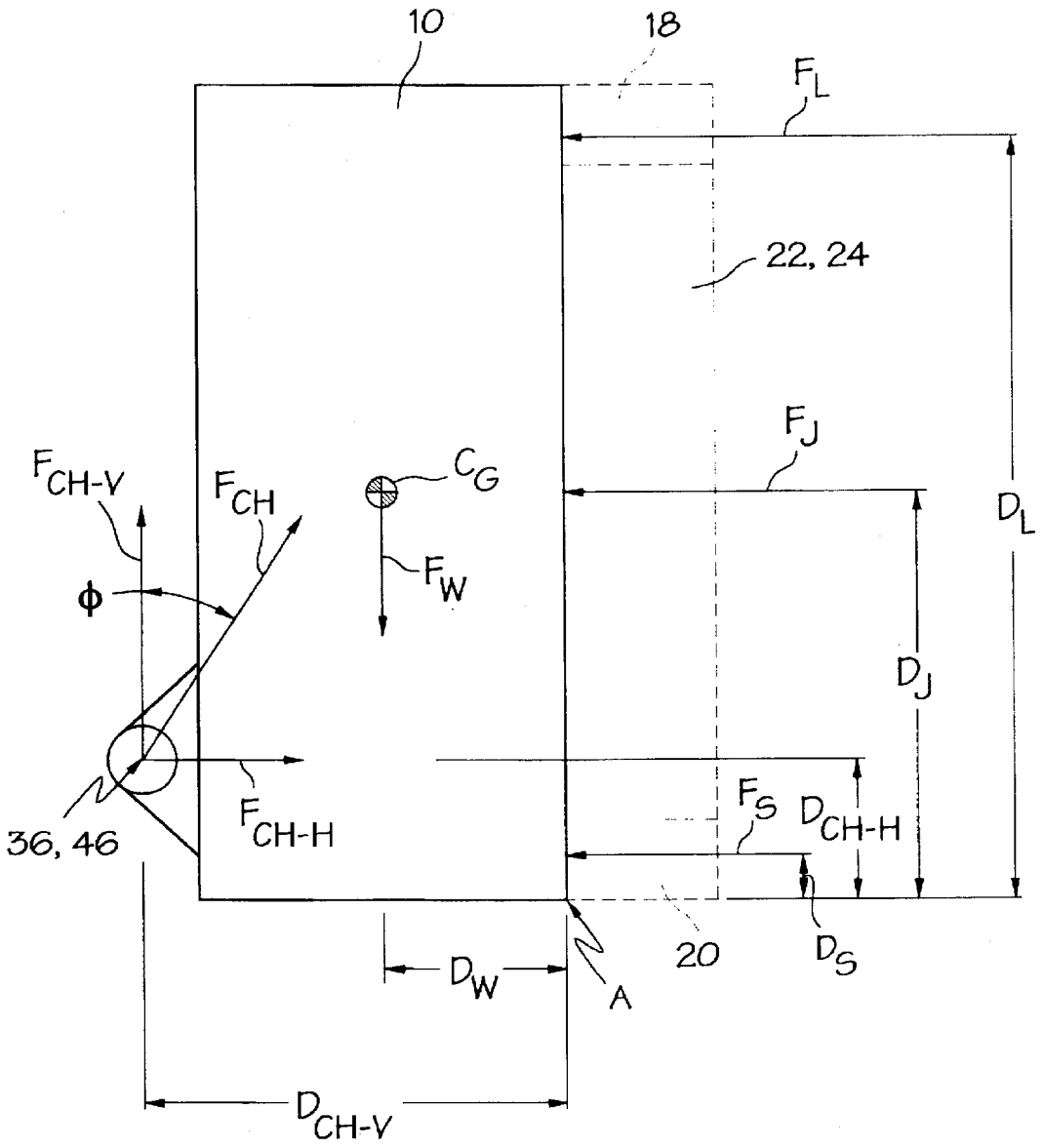
FIG. 3 is a free body diagram of the guillotine-style door closure system in the closed position.

As shown in FIG. 3, to aid in determining the optimal vertical location $D_{CH-H}$ of the attachment pins 36, 46, the various forces applied to the door 10 when it is in the closed, or down, position are displayed graphically in a free body diagram.

The weight force of the door, $F_W$, is applied at the center of gravity $C_G$ of the door 10. The reactive force exercised by the lintel 18 against the door 10, $F_L$, is taken as acting at the geometric center of the lintel where the lintel meets the door.

The force $F_J$ represents the combined reactive forces that the right and left jambs 24 and 22 apply to the door 10, and is taken as acting at the geometric center of the jambs. $F_S$ represents the reactive force that the sill 20 applies to the door 10, and is taken as applied at the geometric center of the sill where the sill meets the door.

The force that the closure chains 32 and 42 apply to the pins 46 and 36 are combined into one resultant force $F_{CH}$. The force $F_{CH}$ acts in tension and only along the axis of the chains. The angle that $F_{CH}$ makes with the vertical plane is indicated by the symbol $\phi$.

In order to aid in the calculations below, $F_{CH}$ is resolved into its corresponding vertical and horizontal components, $F_{CH-V}$ and $F_{CH-H}$. $F_{CH-V}$, the vertical component of $F_{CH}$, is equal to the cosine of the angle $\phi$ multiplied by $F_{CH}$. $F_{CH-H}$ represents the horizontal component of $F_{CH}$, and is equal to the sine of the angle $\phi$ multiplied by $F_{CH}$.

In order to determine the optimal pin location, a first fundamental principle of mechanics is applied to the system, which requires that the sum of the vertical forces in a closed system equal zero. Summing the forces in the vertical direction, the following equation results:

$$F_W - F_{CH-V} = 0 \quad \text{(Eq. 1)}$$

Substituting in the definition for $F_{CH-V}$, the equation becomes $$F_W - F_{CH} * \cos\phi = 0 \quad \text{(Eq. 2)}$$

Hence, manipulating the equation, it is seen that $$F_{CH} = F_W / \cos\phi \quad \text{(Eq. 3)}$$

Furthermore, from equation 1, it is noted that $$F_W = F_{CH-V} \quad \text{(Eq. 4)}$$

It was also noted above in the definitions that $F_{CH-H}$ equals $F_{CH} * \sin\phi$. Manipulating this equation, it follows that $$F_{CH-H} / \sin\phi = F_{CH} \quad \text{(Eq. 5)}$$

Substituting the quantity representing $F_{CH}$ in equation 5 into equation 3, the following results:

$$F_{CH-H} / \sin\phi = F_W / \cos\phi \quad \text{(Eq. 6)}$$

Manipulating this equation 6, it is revealed that $$F_{CH-H} = F_W * \tan\phi \quad \text{(Eq. 7)}$$

A second fundamental principle of mechanics is next applied to the system, which requires that the sum of the horizontal forces in a closed system equal zero. Summing the forces in the horizontal direction, the following equation results:

$$F_L + F_J + F_S - F_{CH-H} = 0 \quad \text{(Eq. 8)}$$

Each of the forces exercised on the door by the lintel, sill, and jambs, $F_L$, $F_J$, and $F_S$, can be further described as a pressure exerted on the applicable door area multiplied by the surface area to which that pressure is applied. The surface area of the abutting sealing surfaces between the furnace door and the lintel is represented by the symbol $A_L$. $A_S$ represents the surface area of the abutting sealing surfaces between the furnace door and the sill, and $A_J$ represents the combined surface area of the abutting sealing surfaces between the furnace door and the two jambs.

Similarly, the pressure forces exerted by the lintel sealing surface onto the furnace door sealing surface is denoted $P_L$. The pressure forces exerted by the two jambs is represented by $P_J$, and the pressure force exerted by the sill is represented by the symbol $P_S$. Thus, it is seen that:

$$F_L = P_L * A_L \quad \text{(Eq. 9)}$$

$$F_J = P_J * A_J \quad \text{(Eq. 10)}$$

$$F_S = P_S * A_S \quad \text{(Eq. 11)}$$

A central object of the present invention is to provide a substantially uniform sealing pressure around the perimeter of the door frame. Thus, it is desired that the pressures along the lintel 18, the sill 20, and the jambs 24 and 22 be equal. In mathematical terms, it is desired that $P_L = P_J = P_S$. Thus, upon determining a desired uniform pressure, designated by the symbol P, it is defined that $$P := P_L = P_J = P_S \quad \text{(Eq. 12)}$$

Substituting equation 12 into equations 9–11, it is seen that $$F_L = P * A_L \quad \text{(Eq. 13)}$$

$$F_J = P * A_J \quad \text{(Eq. 14)}$$

$$F_S = P * A_S \quad \text{(Eq. 15)}$$

Substituting these resultant equations 13–15 into equation 8 provides the following outcome:

$$P * (A_L + A_J + A_S) - F_{CH-H} = 0 \quad \text{(Eq. 16)}$$

Substituting equation 7 into equation 16, and solving for P, the result is $$P = \frac{F_w * \tan\phi}{(A_L + A_J + A_S)} \quad \text{(Eq. 17)}$$

A third fundamental principal of mechanics is next applied to the system, which requires that the sum of the moments about any point in a closed system equal zero. In the following equations, the moments about an arbitrary position designated as Point A in FIG. 3 will be summed. The horizontal distance from Point A to the center of gravity of the door, where the weight force is applied, is represented by the symbol $D_W$. $D_{CH-V}$ represents the horizontal distance from Point A to the point where $F_{CH-V}$ is applied.

The vertical distance from Point A to the point where $F_{CH-H}$ is applied is shown as $D_{CH-H}$. $D_S$, $D_J$, and $D_L$ represent the vertical distances from Point A to the location where the forces $F_S$, $F_J$, and $F_L$ are applied, respectively.

Summing the moments about Point A, the resultant formula is:

$$F_W * D_W + F_L * D_L + F_J * D_J + F_S * D_S - F_{CH-H} * D_{CH-H} - F_{CH-V} * D_{CH-V} = 0 \quad \text{(Eq. 18)}$$

Solving for $D_{CH-H}$, $$D_{CH-H} = \frac{F_W * D_W + F_L * D_L + F_J * D_J + F_S * D_S - F_{CH-V} * D_{CH-V}}{F_{CH-H}} \quad \text{(Eq. 19)}$$

Where $F_W$ is the weight of the door $F_L = P * A_L$ (eq. 13)

$F_J = P * A_J$ (eq. 14)

$F_S = P * A_S$ (eq. 15)

$F_{CH\text{-}V}=F_W$ (eq. 4)

$F_{CH\text{-}H}=F_W * \tan\phi$(eq. 7)

Furthermore, the weight of the door, the angle $\phi$, and the geometric dimensions and areas are physically measured quantities, and the pressure P is the uniform pressure that is the desired sealing pressure which is preferably selected to be between approximately 0.3 psi and approximately 0.6 psi.

As discussed above, there may be an embodiment of the door closure system in which the door mates with the jambs and lintel of the frame, but does not mate with the sill. In this case, $F_S$, $P_S$ and $A_S$ will all equal zero, and will thus be eliminated from the equations.

Thus, utilization of equation 19 will provide the vertical distance that the pins 46 and 36 should be located above the rear face 40 such that the door will seal with the door frame in a manner that provides a substantially uniform sealing pressure around the perimeter of the door frame.

To aid in the understanding of the application of these equations, a sample calculation is provided below. The given dimensions of the furnace door closure system are as follows:

| | |
|---|---|
| $A_L = 600$ in$^2$ | Door Height = 70 in. |
| $A_S = 1000$ in$^2$ | Door Width = 60 in. |
| $A_S = 600$ in$^2$ | $\phi = 30°$ |
| $D_W = 6$ in. | $D_L = 65$ in. |
| $D_J = 35$ in. | $D_S = 5$ in. |
| $D_{CH\text{-}V} = 14$ in. | $F_W = 2000$ lbs. |

Furthermore, the desired pressure P is specified as 0.525 psi. Thus, from equation 13, $$F_L = .525 * 600; \quad = 315 \text{ lbs}$$

From equation 14, $$F_J = .525 * 1000 \quad = 525 \text{ lbs}$$

From equation 15

$$F_s = .525 * 600 \quad = 315 \text{ lbs}$$

From equation 4

$$F_{CH\text{-}V} = 2000$$

From equation 7

$$F_{CH\text{-}H} = 2000 * \tan\phi \quad = 1155 \text{ lbs}$$

Substituting these results into equation 19, $$D_{CH\text{-}H} = \frac{2000*6 + 315*65 + 525*35 + 315*5 - 2000*14}{1155} \quad = .21 \text{ in.}$$

Thus, in the above example the attachment pins 36, 46 should be located 21 inches above the rear face 40 in order to ensure that the door will seal with a substantially uniform sealing pressure around the perimeter of the frame.

As discussed above, since the closure chains 32, 42 transmit force axially, it does not matter where they are physically attached to the door 10, provided that their projected forces $F_{CH}$, project through the plane of the rear vertical side (facing the furnace opening 16) of the door at the proper spot. Essentially, the closure chains 32, 42 can be attached to the door 10 anywhere along that projected line of force $F_{CH}$. For example, a thick door of short height may calculate to have attachment points below the bottom of the door itself. In such a case, an extension could be mounted to the closure bar 49 to extend the attachment points to their proper positions. To minimize the length of this extension from the closure bar 49, this extension would be mounted perpendicular to the projected line of force.

Additionally, depending upon the circumstances, the above calculations may indicate that the attachment points for the closure chains be above the vertical centerline, or on the vertical centerline itself. However, this will occur only in rare circumstances.

Based upon the above description and example, it follows that it is within the scope of the present invention to calculate the vertical height in which to attach door support lines to a door of a guillotine-style door closure system according to a sum of all vertical forces equaling approximately zero, a sum of all horizontal forces equaling approximately zero, and a sum of all moments about a predetermined point equaling approximately zero, when the door closure system is in a closed position; thereby effectuating a substantially uniform sealing force of the door against a door frame. And it also follows that it is within the scope of the present invention to calculate the vertical height in which to attach the door support lines according to a substantial equality of pressure exerted by the door frame components (such as the lintel, the sill and the left and right jambs) on the door in the closed position.

Accordingly, by using the above method and equation, the location of the attachment point of the pins 36, 46 can be located such that the sealing forces of the door 10 against the door frame 12 will be substantially uniform about the perimeter of the door frame. And furthermore, the use of the above method and equation assures that the sealing forces between the door and the door frame remain in the range between approximately 0.3 psi and approximately 0.6 psi.

Having described the invention in detail and by reference to the drawings, it will be apparent that modifications and variations are possible without departing from the scope of the invention as defined in the following claims.

What is claimed is:

1. For use with a furnace having a side wall including a vertically-oriented opening bordered by a frame having a lintel, a sill and left and right jambs, a door closure system comprising:

a furnace door shaped to cover said opening and engage said frame;

first and second support lines extending between said side wall and said door, said support lines being pivotally attached to said door at a point below a horizontal centerline of said door and extending upwardly rearwardly of said door and being of sufficient length to allow said door to be raised substantially vertically parallel to said wall to expose said opening, whereby a weight force of said door against said frame effects a seal of said door with said frame.

2. The door closure system of claim 1 wherein said door support lines are attached to said door such that said door effects a substantially uniform sealing force against said frame along said lintel, sill, and left and right jambs of said frame.

3. The door closure system of claim 1, wherein:

said door support lines are attached to said door at a vertical height;

said vertical height being calculated according to a sum of all vertical forces when the door closure system is in a closed position, a sum of all horizontal forces when the door closure system is in said closed position, and a sum of all moments about a predetermined point when the door closure system is in said closed position;

said sum of all vertical forces, said sum of all horizontal forces and said sum of all moments about a predetermined point equals predetermined values to effectuate a substantially uniform sealing force against said frame along said lintel, sill, and left and right jambs of said frame.

4. The door closure system of claim 3, wherein said sum of all vertical forces equals approximately zero, said sum of all horizontal forces equals approximately zero, and said sum of all moments about said point equals approximately zero.

5. The door closure system of claim 4, wherein said vertical height is calculated according to a substantial equality of a pressure exerted by said lintel on said door, a pressure exerted by said sill on said door, and a combined pressure exerted by said left and right jambs on said door.

6. The door closure system of claim 5, wherein said vertical height is calculated according to a predetermination that said pressure exerted by said lintel on said door, said pressure exerted by said sill on said door, and said combined pressure exerted by said left and right jambs on said door is in a range between 0.3 psi and 0.6 psi.

7. The door closure system of claim 1, wherein said door support lines are attached to said door such that said door effects a sealing force against said frame of between approximately 0.3 psi and approximately 0.6 psi.

8. The door closure system of claim 1, wherein said frame includes a gasket or liner positioned to engage said door when said door is lowered into a closed position.

9. The door closure system of claim 1, wherein said door includes a gasket or liner positioned to engage said frame when said door is lowered into a closed position.

10. The door closure system of claim 1, wherein said door support lines comprise chains.

11. The door closure system of claim 1 wherein said door support lines are pivotally attached to said frame, approximate said lintel and said jambs.

12. The door closure system of claim 1 wherein said door support lines are pivotally attached to said furnace, approximate said lintel and said jambs.

13. The door closure system of claim 1 wherein said door includes a pair of opposing vertical sides and said door support lines are respectively pivotally attached to said vertical sides.

14. The door closure system of claim 1 wherein said door includes a closure bar attached to said door and extending transversely with respect to an outer wall of said door; and said door support lines are attached to ends of said closure bar.

15. The door closure system of claim 1, wherein said door has a weight and wherein said right and said left support lines are attached to said door at a vertical height $D_{CH\text{-}H}$, said vertical height $D_{CH\text{-}H}$ depending upon the equation:

$$D_{CH\text{-}H} = \frac{F_W * D_W + F_L * D_L + F_J * D_J + F_S * D_S - F_{CH\text{-}V} * D_{CH\text{-}V}}{F_{CH\text{-}H}}$$

wherein $F_W$ is said weight of said door, $F_L$ is a uniform desired pressure multiplied by a surface area of said lintel which abuts said door, $F_J$ is said uniform desired pressure multiplied by a combined surface area of said left jamb which abuts said door and said right jamb which abuts said door, $F_S$ is said uniform desired pressure multiplied by a surface area of said sill which abuts said door, $F_{CH\text{-}V}$ is a vertical component of a force applied by said support lines, and $F_{CH\text{-}H}$ is a horizontal component of said force applied by said support lines.

16. For use with a furnace having a side wall including a vertically-oriented opening bordered by a frame, a door closure system comprising:

a furnace door shaped to cover said opening and engage a portion of said frame;

at least one flexible door support line extending between said side wall and said door, said support line being pivotally attached to said door and extending upwardly rearwardly of said door and being of sufficient length to allow said door to be raised substantially vertically parallel to said wall to expose said opening, whereby a weight force of said door against said portion of said frame effects a seal of said door with said frame;

wherein said door support line is attached to said door at a vertical height, said vertical height being calculated according to a sum of all vertical forces when the door closure system is in a closed position, a sum of all horizontal forces when the door closure system is in said closed position, and a sum of all moments about a predetermined point when the door closure system is in said closed position; and wherein said sum of all vertical forces, said sum of all horizontal forces and said sum of all moments about a predetermined point equals predetermined values to effectuate a substantially uniform force of said door along said portion of said frame.

17. The door closure system of claim 16, wherein said sum of all vertical forces equals approximately zero, said sum of all horizontal forces equals approximately zero, and said sum of all moments about said point equals approximately zero.

18. The door closure system of claim 17, wherein said frame includes a plurality of frame components adapted to mate with said door in said closed position, and said vertical height is calculated according to a substantial equality of a pressure exerted by said frame components on said door in said closed position.

19. The door closure system of claim 18, wherein said vertical height is calculated according to a predetermination that said pressure exerted by each of said frame components on said door is in a range between 0.3 psi and 0.6 psi.

20. The door closure system of claim 19, wherein said frame components include a lintel and a pair of jambs.

21. The door closure system of claim 20, wherein said frame components include a sill.

22. A furnace door closure system comprising:

a furnace opening on a vertical side of the furnace, said opening having a frame, said frame including a lintel, a sill, a left jamb and a right jamb;

a furnace door adapted to mate with said frame in a closed position, having a vertical centerline, a front vertical side facing away from said furnace opening, a rear vertical side facing said furnace opening, a left vertical side, a right vertical side and a top;

a first closing chain mounted, at one end of said first chain, to said vertical side of said furnace approximate said left jamb and said lintel, and mounted, at the other end of said first chain, to a left pin extending from said furnace door, said left pin being located approximate said left vertical side, below said vertical centerline and distal from said rear vertical side; and a second closing chain mounted, at one end of said second chain, to said vertical side of said furnace approximate said right jamb and said lintel, and mounted, at the other end of said first chain, to a right pin extending from said furnace door approximate said right vertical side, below said vertical centerline and distal from said rear vertical side;

said first and second closing chains being of sufficient length such that said first and second chains provide horizontal force to hold said door in said frame when said door is hung on said first and second closing chains.

23. The door closure system of claim 22, wherein said left and right pins extend from said furnace door at a vertical height, said height depending upon:

a sum of all vertical mechanical forces being substantially equal to zero when the door closure system is in said closed position;

a sum of all horizontal mechanical forces being substantially equal to zero when the door closure system is in said closed position; and a sum of all moments about a predetermined point being substantially equal to zero when the door closure system is in said closed position.

24. The door closure system of claim 23, wherein said height depends upon a pressure exerted by said lintel on said door, a pressure exerted by said sill on said door, and a combined pressure exerted by said left and right jambs on said door being substantially equal to each other.

25. The door closure system of claim 24, wherein said height depends upon said pressure exerted by said lintel on said door, said pressure exerted by said sill on said door, and said combined pressure exerted by said left and right jambs on said door being in the range of approximately 0.3 psi to approximately 0.6 psi.

* * * * *